US012324497B2

(12) United States Patent
Cragg

(10) Patent No.: US 12,324,497 B2
(45) Date of Patent: Jun. 10, 2025

(54) STORAGE BAGS

(71) Applicant: James Cragg, Carson, CA (US)

(72) Inventor: James Cragg, Carson, CA (US)

( * ) Notice: Subject to any disclaimer, the term of this patent is extended or adjusted under 35 U.S.C. 154(b) by 136 days.

(21) Appl. No.: 17/897,068

(22) Filed: Aug. 26, 2022

(65) Prior Publication Data

US 2024/0065396 A1 Feb. 29, 2024

(51) Int. Cl.
*A45C 7/00* (2006.01)
*A45C 13/10* (2006.01)

(52) U.S. Cl.
CPC ..... *A45C 7/0095* (2013.01); *A45C 13/103* (2013.01)

(58) Field of Classification Search
CPC ..... A45C 7/0095; A45C 13/103
USPC ..... 383/2
See application file for complete search history.

(56) References Cited

U.S. PATENT DOCUMENTS 3,236,234 A * 2/1966 Buckley ..... A61F 5/3784 450/137
8,529,481 B1 * 9/2013 Lois ..... A41D 13/0005 602/3
2003/0145636 A1 * 8/2003 Nykoluk ..... A44B 19/301 70/68
2006/0016530 A1 * 1/2006 Volk ..... A45C 13/18 150/101
2006/0016532 A1 * 1/2006 Volk ..... A45C 13/18 150/108
2012/0311785 A1 * 12/2012 Goldberg ..... A47C 31/105 24/389
2017/0295892 A1 * 10/2017 Goldberg ..... B65D 33/2541
2018/0271196 A1 * 9/2018 Hussey ..... A41D 13/1153
2022/0192334 A1 * 6/2022 Ratigan ..... A45F 4/02

* cited by examiner

*Primary Examiner* — Peter N Helvey
(74) *Attorney, Agent, or Firm* — Camuti Law Group APC; Nathan B. Camuti

(57) ABSTRACT

There is provided a bag comprising a back panel and one or more flaps extending from the back panel, wherein the back panel and the one or more flaps lay substantially flat when in an unzipped configuration, a zipper attached to and extending around an outer edge of the back panel and the one or more flaps, wherein the one or more flaps form a first side panel, a second side panel, and a front panel of the bag when the bag is in a zipped configuration, a restrictive element having a first end attached to the bag on a first side of the zipper and a second end selectively attached to the bag on a second side of the zipper using a fastener element, wherein, when the second end is engaged on the second side of the zipper, the restrictive element spans the zipper and restricts operation thereof.

18 Claims, 11 Drawing Sheets

STORAGE BAGS

BACKGROUND

Presently, a bag having a zipper generally features a length-wise slit opening along a top of the bag, and items are placed into the bag through the slit opening. In order to access items in the bag, one has to rummage around to find the desired items. Other types of storage bags may unfold flat to reveal pouches and holders to store items but lack the security of an outer zipper to completely enclose and secure the inner pockets and pouches of items when not in use. Furthermore, zippers often pose difficulties in staying partially unzipped, such that when one only intends to partially unzip the bag to create a partial opening for easy access, the zipper slips past and unzips entirely, resulting in items tumbling out of the bag. Accordingly, there is a need for a system for a storage bag that address the above noted problems and also provides additional features.

SUMMARY

The present disclosure is directed to storage bags substantially as shown in and/or described in connection with at least one of the figures, as set forth more completely in the claims.

In some embodiments, the present disclosure includes a bag, comprising a back panel, at least one flap extending from the back panel, wherein the back panel and the at least one flap extending from the back panel lie substantially flat when in an unzipped configuration, a zipper attached to and extending around an outer edge of the back panel and the at least one flap extending from the back panel, wherein the at least one flap comprises at least one of a first side panel, a second side panel, and a front panel of the bag when the bag is in a zipped configuration, a first restrictive element having a first end and a second end, wherein the first end is attached to the bag on a first side of the zipper and the second end is selectively attached to the bag on a second side of the zipper using a fastener element, wherein when the second end is engaged on the second side of the zipper, the first restrictive element spans the zipper and restricts movement of a first zipper slider forming a first selectively openable aperture of the bag.

In some embodiments, the at least one flap includes a first flap extending from a first side edge of the back panel, a second flap extending from a second side edge of the back panel opposite the first side edge of the back panel, and a third flap extending from a third side edge of the back panel, wherein when the bag is in a zipped configuration, the first flap meets a first side edge of the third flap, the second flap meets a second side edge of the third flap opposite the first side of the third flap, and a third side edge of the third flap meets a fourth side edge of the back panel.

In some embodiments, the bag further comprises a second zipper slider and a second restrictive element, wherein when the first zipper slider and the second zipper slider are positioned between the first restrictive element and the second restrictive element, and the first restrictive element is engaged and the second restrictive element is engaged, the restriction of the zipper sliders by the first and the second restrictive elements forms a second selectively openable aperture therebetween.

In some embodiments, the second selectively openable aperture is one of a top panel of the bag and a side panel of the bag.

In some embodiments, when the fastener element is engaged, the restrictive element is substantially flush against the zipper thereby restricting movement of the zipper slider along a length of the zipper when the zipper slider abuts the restrictive element.

In some embodiments, the first end of the restrictive element is attached to the bag via a selective attachment.

In some embodiments, the bag is selectively openable at one of a first side, a second side, and a top side.

In some embodiments, the back panel further comprises one or more removable support elements inserted along a length of the back panel, extending from a top of the back panel to a bottom of the back panel.

In some embodiments, the removable support elements are inserted across a first flap, the back panel, and a second flap, substantially perpendicular to the length of the back panel from which the removable support elements were removed from, thereby maintaining the bag in a substantially flat configuration while the bag is in the unzipped configuration.

In some embodiments, the removable support elements are made of one of metal, wood, polyethylene, and cardboard.

In some embodiments, the back panel further comprises a plurality of securing mechanisms to attach at least one removable strap forming one of a shoulder bag and a backpack.

In some embodiments, the restrictive element is one of a strap and a handle.

In some embodiments, the restrictive element is made of a flexible material, including canvas, nylon, cotton, polyester, leather, rubber, or any combination thereof.

In some embodiments, the fastener element is one of a snap fastener, a button, a hook and loop fastener, a hook and eye fastener, a toggle clasp, a snap hook, and a buckle.

In some embodiments, the front panel includes a bottom, a front, and a top when in a zipped configuration.

In some embodiments, a first side of the fastener element is disposed on the restrictive element and a second side of the fastener element is disposed on the second side of the zipper.

In some embodiments, the first selectively openable aperture is a side panel of the bag.

DETAILED DESCRIPTION

Figure 1:
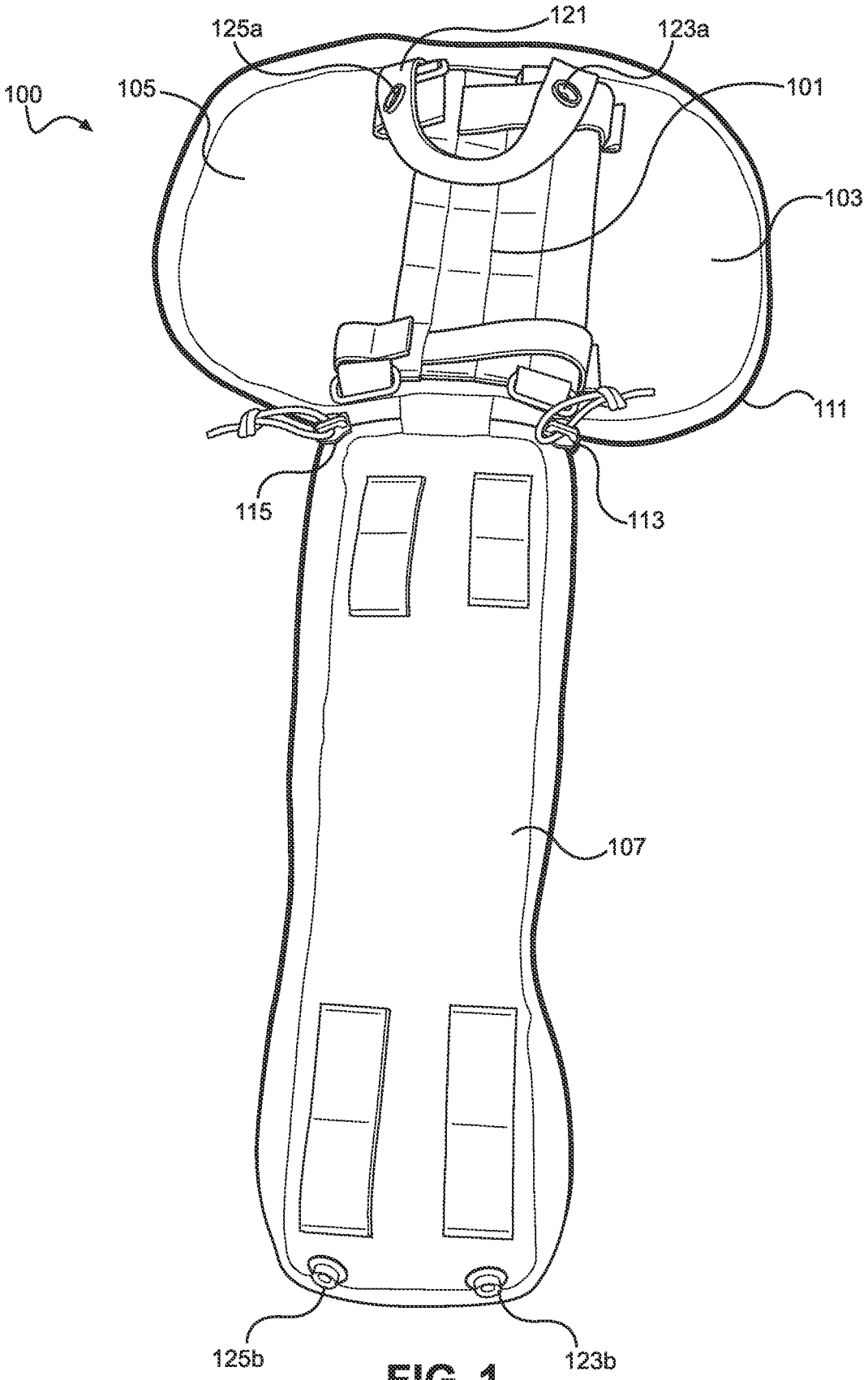
FIG. 1 shows a diagram of the outside surface of a bag in an unzipped configuration, according to one embodiment of the present disclosure.

The following description contains specific information pertaining to implementations in the present disclosure. The drawings in the present application and their accompanying detailed description are directed to merely exemplary implementations. Unless noted otherwise, like or corresponding elements among the figures may be indicated by like or corresponding reference numerals. Moreover, the drawings and illustrations in the present application are generally not to scale and are not intended to correspond to actual relative dimensions.

FIG. 1 shows a diagram of the outside surface of a bag in an unzipped configuration, according to one embodiment of the present disclosure. As depicted, bag 100 is in an unzipped configuration laying substantially flat. In the depicted embodiment, bag 100 includes back panel 101, first flap 103, second flap 105, and third flap 107. In the depicted embodiment, first flap 103 and second flap 105 are substantially similar in shape and size, as mirror images of each other. In the depicted embodiment, first flap 103 and second flap 105 each have a substantially semicircle shape, wherein the semicircle shape includes a flat side and curved side. In the depicted embodiment, the flat side of the semicircle is directly attached to a side edge of back panel 101. First flap 103 extends from a first side edge of back panel 101, and second flap 105 extends from a second side edge of back panel 101, wherein the first side edge of back panel 101 and second side edge of back panel 101 are on opposite sides of each other. As depicted, third flap 107 extends from a third side edge of back panel 101. In the depicted embodiment, third flap 107 has a substantially elongated rectangle shape. In some embodiments, first flap 103 and second flap 105 may have other shapes, such as a rectangular shape, a square shape, triangular shape, other geometric shapes, and combinations thereof. In some embodiments, third flap 107 may have other shapes, such as a rectangular shape, a square shape, triangular shape, other geometric shapes, and combinations thereof.

As depicted, zipper 111 is attached to and extends around an outer edge of back panel 101, first flap 103, second flap 105, and third flap 107. More specifically, in the depicted embodiment, zipper 111 is attached to and extends around a curved edge of first flap 103, a fourth side edge of back panel 101, a curved edge of second flap 105, and an outer edge of at least three sides of third flap 107. The fourth side edge of back panel 101 may be included in or form a portion of the perimeter of back panel 101. In the depicted embodiment, a first side and a second side of third flap 107 are opposite each other, and the length of a first side of third flap 107 and the length of a second side of third flap 107 are each substantially equal to each of the length of the curved edge of first flap 103 and the length of the curved edge of second flap 105. In the depicted embodiment, a third side of third flap 107 is directly attached to the third side edge of back panel 101. As depicted, the length of a fourth side of third flap 107 is substantially equal to the length of the fourth side edge of back panel 101. In some embodiments, zipper 111 is a zipper with teeth. In some embodiments, zipper 111 with teeth may be made of one of metal teeth, coil teeth, and plastic teeth. In some embodiments, zipper 111 has zip-locking tracks with a slider piece that directs the zip-locking tracks into place. In some embodiments, zipper 111 with zip-locking tracks is made of plastic.

As depicted, bag 100 has two zipper sliders 113, 115. In some embodiments, bag 100 may have one zipper slider. In some embodiments, bag 100 may have two-way zipper sliders that may be closed or opened in two opposite directions at the same time. Zipper sliders 113, 115 may be made of one of plastic, metal, and any combination thereof. As depicted, bag 100 is in an unzipped configuration, and zipper sliders 113, 115 are located on opposite sides of the attachment point between the third side edge of back panel 101 and the third side of third flap 107. As depicted, zipper sliders 113, 115 are oriented in opposite directions such that as both zipper sliders 113, 115 are pulled to close the bag they move in opposite directions. In other words, if both zipper sliders 113, 115 are pulled in a first direction, a first zipper will zip up the bag, while a second zipper will unzip the bag. When bag 100 is in a zipped configuration, first flap 103, second flap 105, and third flap 107 each fold over forming at least a first side panel, a second side panel, and a front panel of bag 100, respectively.

In the depicted embodiment, back panel 101 and third flap 107 further comprise one or more loops, straps, rings, and the like to attach and secure various items. In some embodiments, first flap 103 and second flap 105 may further comprise one or more loops, straps, rings, and the like to attach and secure various items. As depicted, bag 100 has a handle attached at or near the fourth side edge of back panel 101. In the depicted embodiment, the handle is also restrictive element 121. In some embodiments restrictive element 121 may be a strap. Restrictive element 121 has a first end and a second end, wherein the first end is attached to back panel 101 on a first side of zipper 111, and the second end may be selectively attached on a second side of zipper 111, wherein when the second end is engaged on the second side of zipper 111, restrictive element 121 spans zipper 111. In some embodiments, bag 100 may further comprise one or more additional restrictive elements attached at additional locations, thereby creating a different sized selectively openable aperture in bag 100 that is in a partially zipped configuration. In some embodiments, the second end of restrictive element 121 is selectively attached on a second side of zipper 111 using one or more fastener elements 123*a*, 123*b*, 125*a*, 125*b*.

In the depicted embodiment, fastener elements 123*a*, 123*b*, 125*a*, 125*b* are snap fasteners. As depicted, first side of fastener element 123*a*, 125*a* are disposed on restrictive element 121 attached on a first side of zipper 111, and second side of fastener element 123*b*, 125*b* are disposed on a second side of zipper 111. In the depicted embodiment, first side of fastener element 123*a* engages with the complementary second side of fastener element 123*b* via a snap fastener, and similarly, first side of fastener element 125*a* engages with the complementary second side of fastener element 125*b* via a snap fastener. In the depicted embodiment, there are two sets of fastener elements 123*a* with 123*b* and 125*a* with 125*b*. In some embodiments, bag 100 may have one set of fastener elements. In some embodiments, there may be more than one set of fastener elements. In some embodiments, the one or more fastener elements is one of a snap fastener, a button, a hook and loop fastener, a hook and eye fastener, a toggle clasp, a snap hook, and a buckle.

In some embodiments, back panel 101 further comprises one or more removable support elements (not shown). In some embodiments, the removeable support elements are inserted along a length of back panel 101, extending from a top of back panel 101 to a bottom of back panel 101. In some embodiments, back panel 101 further comprises one or more pockets, slots, and straps in which to insert the removeable support elements. In some embodiments, the removable support elements may be inserted across first flap 103, back panel 101, and second flap 105, substantially perpendicular to the length of back panel 101 from which the removable support elements were removed from, thereby maintaining bag 100 in a substantially flat configuration while bag 100 is in the unzipped configuration. In some embodiments, first flap 103, back panel 101, and second flap 105 further comprise one or more pockets, slots, and straps in which to insert the removeable support elements to maintain bag 100 in a substantially flat configuration while bag 100 is in the unzipped configuration. In some embodiments, the removeable support elements are made of one of metal, wood, polyethylene, cardboard, and any combination thereof.

Figure 2:
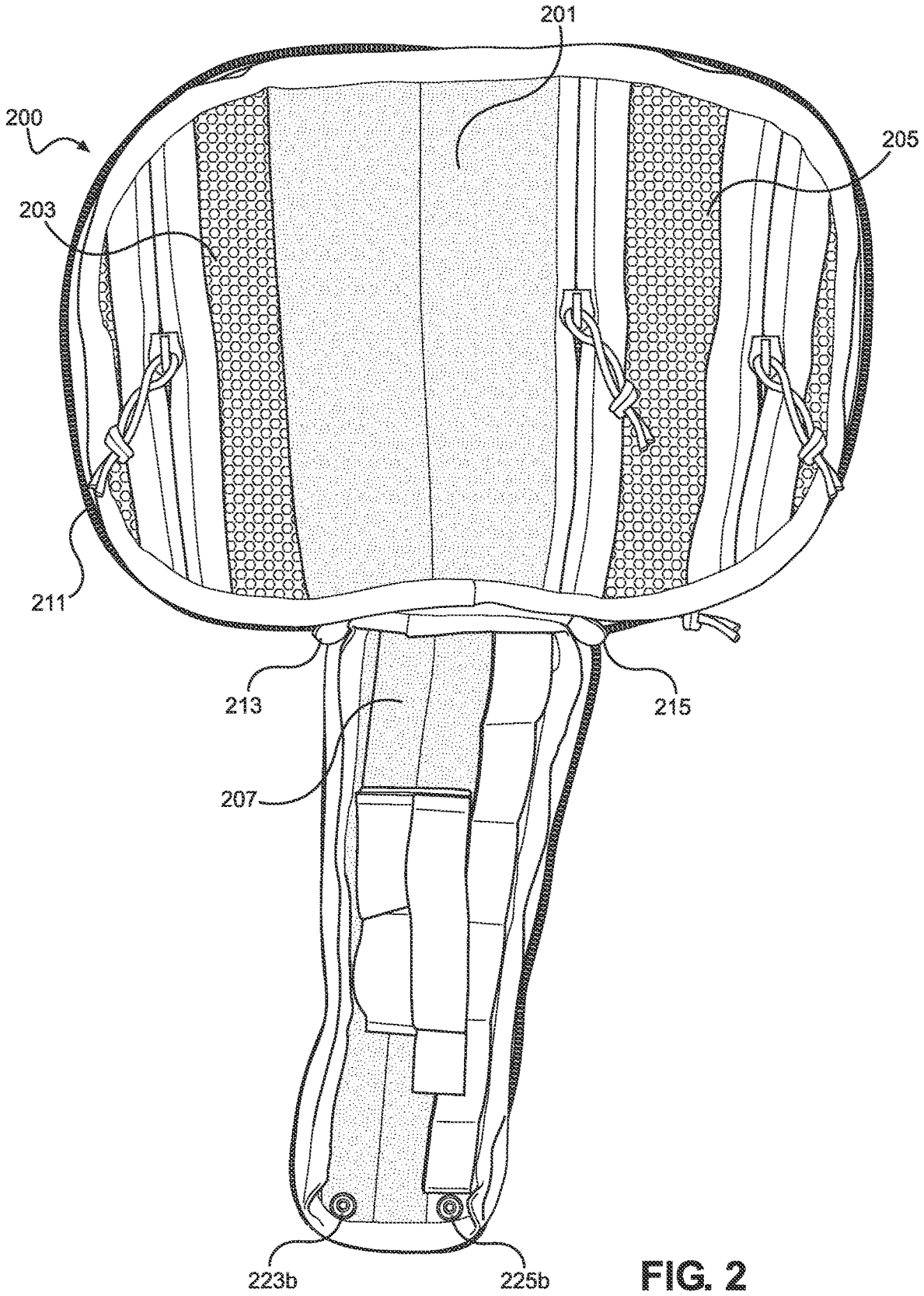
FIG. 2 shows a diagram of the inside surface of the bag in an unzipped configuration, according to one embodiment of the present disclosure.

FIG. 2 shows a diagram of the inside surface of the bag in an unzipped configuration, according to one embodiment of the present disclosure. As depicted, bag 200 is in an unzipped configuration laying substantially flat. In the depicted embodiment, bag 200 includes back panel 201, first flap 203, second flap 205, and third flap 207. The inside of bag 200 features various zip pockets, loops, and straps to store and secure various items.

As depicted, zipper 211 is attached to and extends around an outer edge of back panel 201, first flap 203, second flap 205, and third flap 207. More specifically, in the depicted embodiment, zipper 111 is attached to and extends around a curved edge of first flap 203, a fourth side edge of back panel 201, a curved edge of second flap 205, and an outer edge of at least three sides of third flap 207.

As depicted, bag 100 has two zipper sliders 213, 215. In some embodiments, the bag may have one zipper slider. Zipper sliders 213, 215 are located on opposite sides of the attachment point between the third side edge of back panel 201 and the third side of third flap 207. When bag 200 is in a zipped configuration, first flap 203, second flap 205, and third flap 207 each fold over forming at least a first side panel, a second side panel, and a front panel of bag 100, respectively. In some embodiments, third flap 207 may fold over forming a top panel, a front panel, and a bottom panel of bag 100.

As depicted, the inner face of second side of fastener elements 223*b*, 225*b* are visible as disposed on a second side of zipper 211 near fourth side of third flap 207. Restrictive element (not visible) is attached to a first side of zipper 211 located on the outside surface of back panel 201. The first side of fastener elements (not visible) are disposed on restrictive element (not visible). The first side of fastener elements (not visible) may selectively attach to second side of fastener elements 223*b*, 225*b*.

Figure 3:
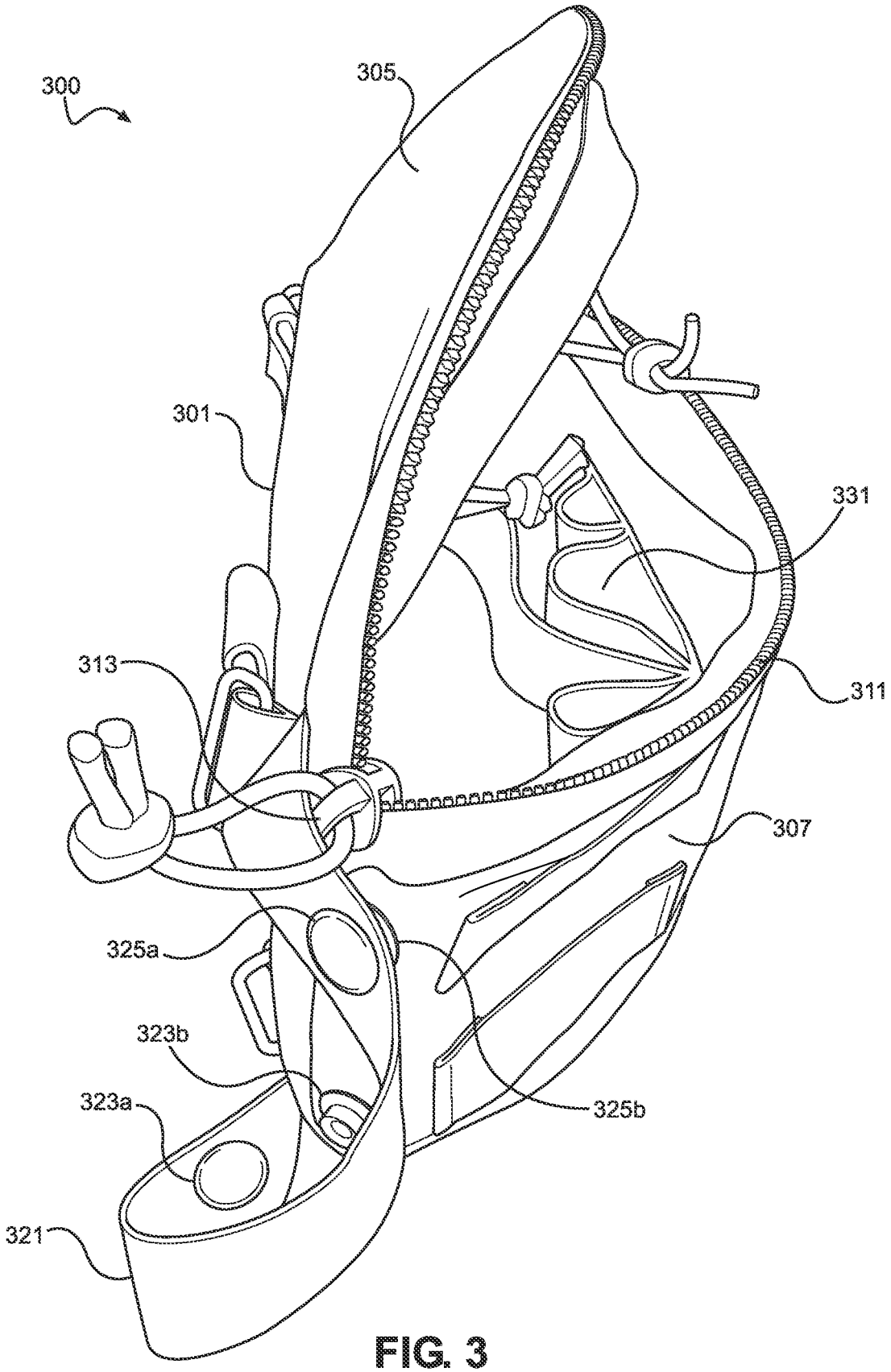
FIG. 3 shows a diagram of the bag in a partially zipped configuration, according to one embodiment of the present disclosure.

FIG. 3 shows a diagram of the bag in a partially zipped configuration, according to one embodiment of the present disclosure. As depicted, zipper slider 313 has partially zipped up bag 300 such that first flap (not pictured) meets a first side of third flap 307, and a fourth side of third flap 307 meets a fourth side edge of back panel 301. As depicted, bag 300 is in a partially zipped configuration with second flap 305 not yet folded over such that second flap 305 meets a second side of third flap 307.

As depicted, first side of fastener elements 323*a*, 325*a* are disposed on restrictive element 321. Additionally, restrictive element 321 has a first end and a second end, wherein the first end is attached to back panel 301 of bag 300 on a first side of zipper 311 and the second end is selectively attached on a second side of the zipper. As depicted, first side of fastener element 323*a* is disposed on the second end of restrictive element 321 and is not engaged with second side of fastener element 323*b*. In the depicted embodiment, second side of fastener element 323*b* is disposed on the second side of zipper 311 on third flap 307, while first side of fastener element 325*a* is engaged with second side of fastener element 325*b*. As depicted, with first side of fastener element 325*a* engaged with second side of fastener element 325*b*, restrictive element 321 spans zipper 311. With first side of fastener element 325*a* engaged with second side of fastener element 325*b* such that restrictive element 321 spans zipper 311, movement of zipper slider 313 is restricted. As a result, bag 300 may remain in a partially zipped configuration, allowing access to a selectively openable aperture 331 in bag 300. In the depicted embodiment, with restrictive element 321 restricts zipper slider 313 from moving past restrictive element 321 to unzip zipper 311. Additionally, in the depicted partially zipped configuration of bag 300, second flap 305 has not yet folded over, allowing access into bag 300 through aperture 331.

Figure 4A:
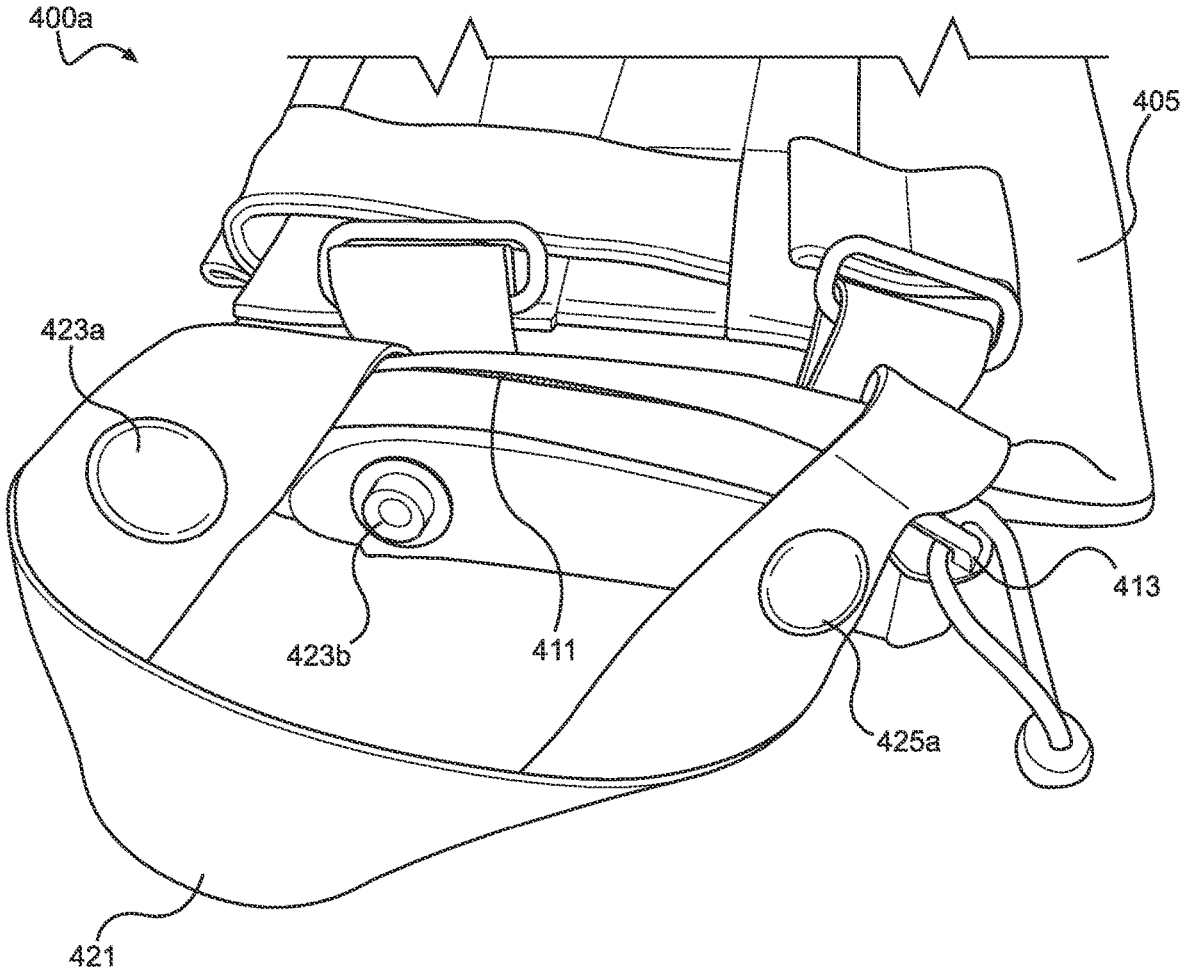
FIG. 4A shows a close-up view of the bag in a partially zipped configuration, according to one embodiment of the present disclosure.

FIG. 4A shows a close-up view of the bag in a partially zipped configuration, according to one embodiment of the present disclosure. In the depicted embodiment, bag 400*a* is in a partially zipped configuration. As depicted, first side of fastener element 423*a* is not engaged with second side of fastener element 423*b*, while first side of fastener element 425*a* is engaged with its counterpart second side of fastener element (not visible) such that restrictive element 421 spans zipper 411. Consequently, zipper slider 413 abuts restrictive element 421 that spans zipper 411, such that zipper slider 413 is restricted from further movement in unzipping zipper 411 past restrictive element 421.

Figure 4B:
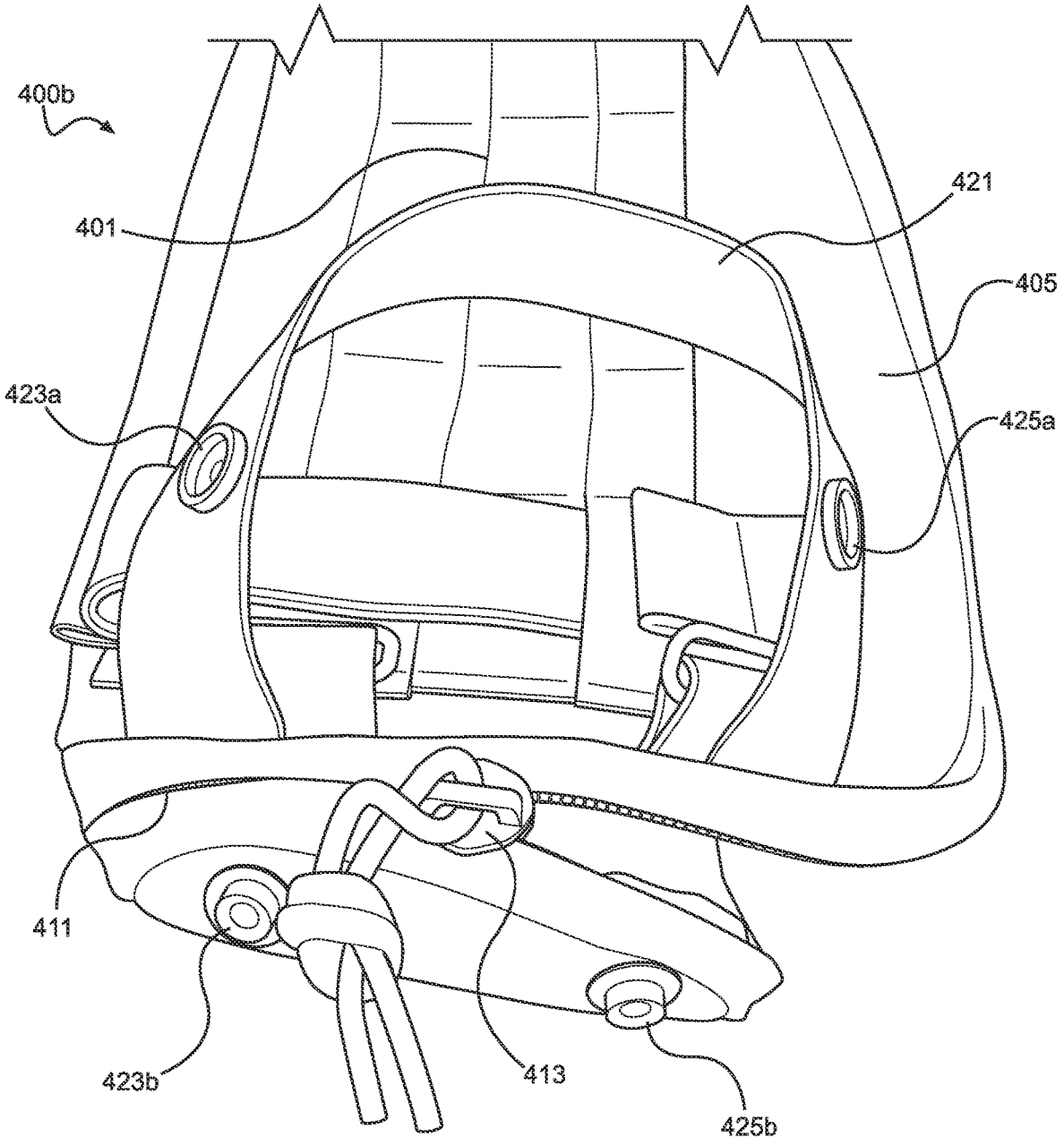
FIG. 4B shows a close-up view of the bag in a partially zipped configuration, according to one embodiment of the present disclosure.

FIG. 4B shows a close-up view of the bag in a partially zipped configuration, according to one embodiment of the present disclosure. In the depicted embodiment, bag 400*b* is in a partially zipped configuration, and first side of fastener elements 423*a*, 425*a* are not engaged with second side of fastener elements 423*b*, 425*b*. As such, restrictive element 421 does not span zipper 411. As a result, zipper slider 413 is not restricted by restrictive element 421 from unzipping zipper 411.

Figure 5A:
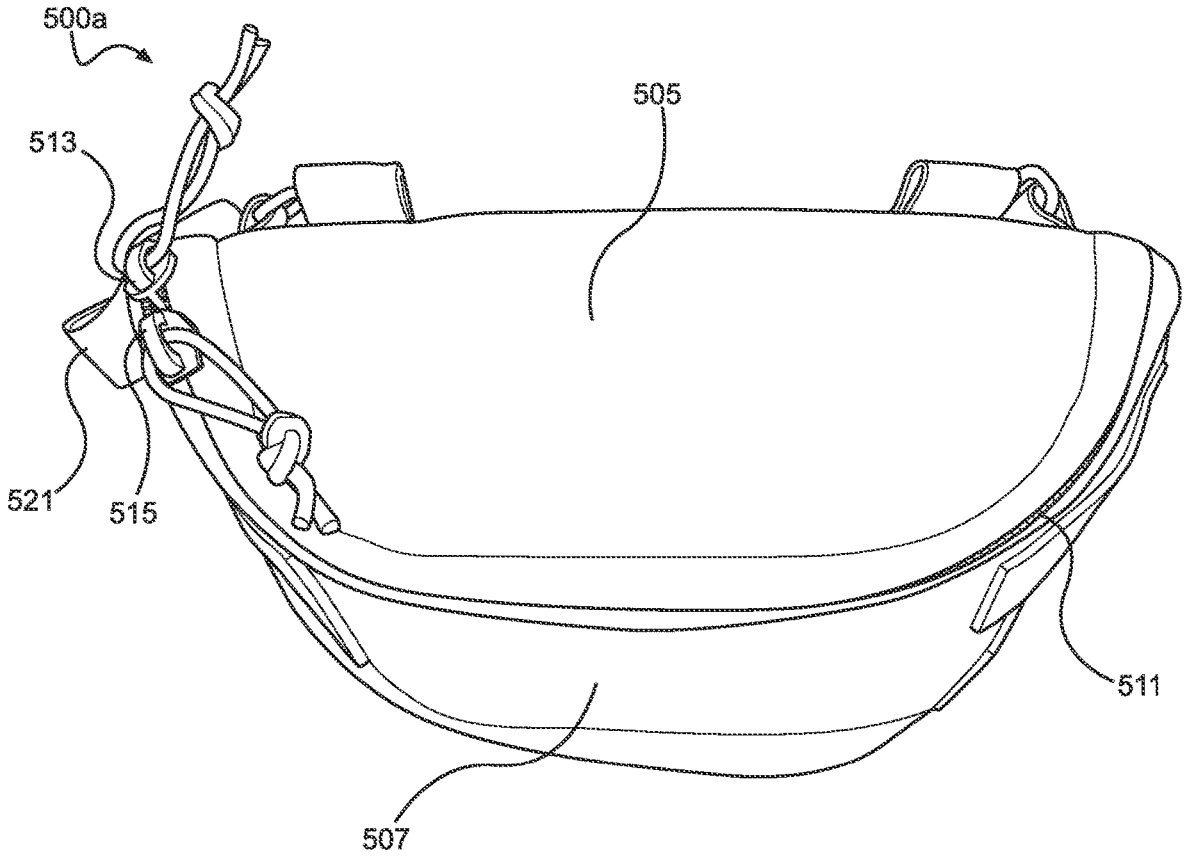
FIG. 5A shows a view of the bag in a zipped configuration, according to one embodiment of the present disclosure.

FIG. 5A shows a view of the bag in a zipped configuration, according to one embodiment of the present disclosure. In the depicted embodiment, bag 500*a* is in a zipped configuration. As depicted, first side of fastener element (not visible) is engaged with second side of fastener element (not visible) such that restrictive element 521 spans zipper 511, thereby restricting zipper slider 513 from moving in a direction that unzips zipper 511. Additionally, in the depicted embodiment, zipper slider 515 has zipped zipper 511 of bag 500*a* such that second flap 505 folds over and the second flap meets a second side of third flap 507.

Figure 5B:
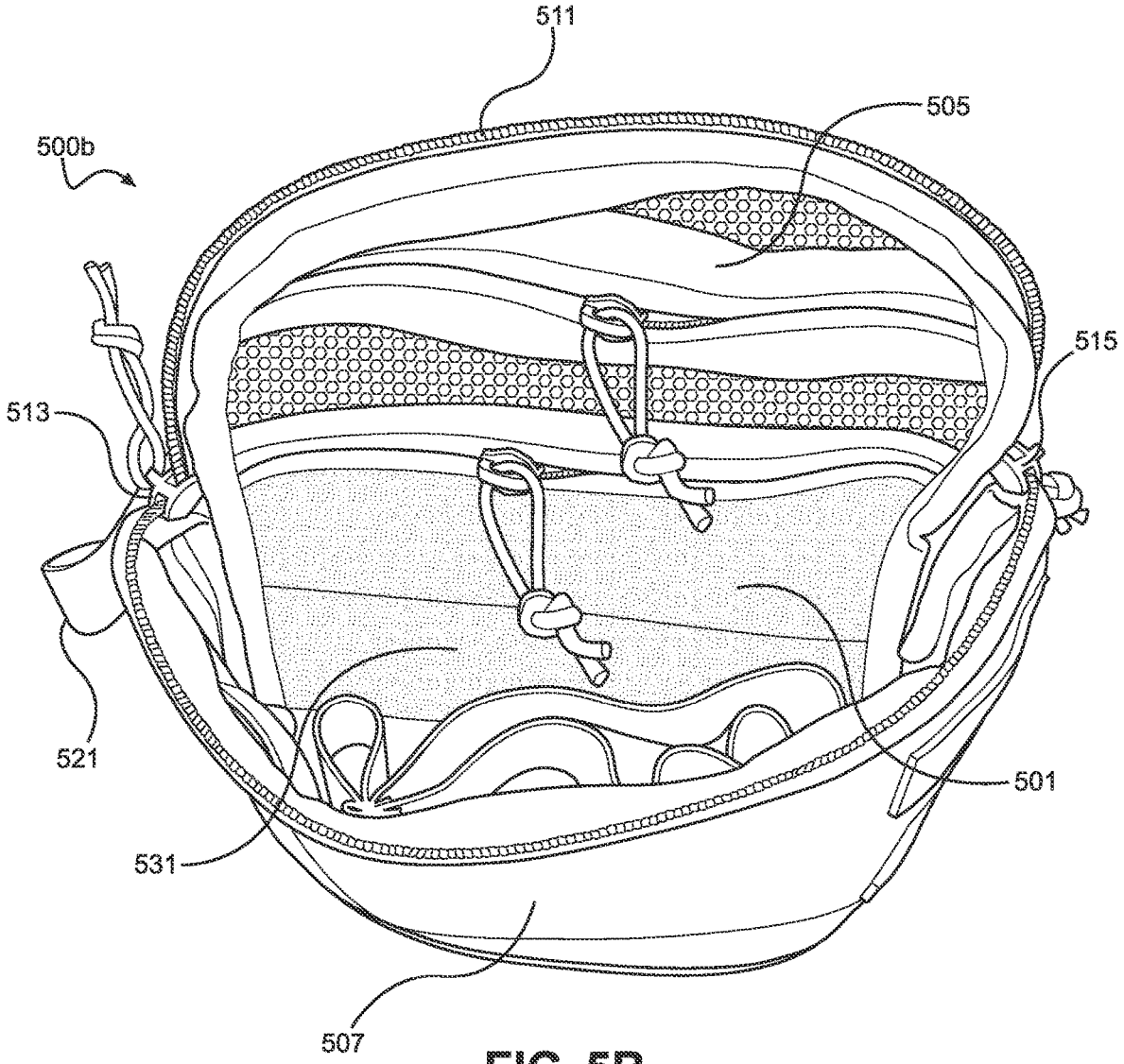
FIG. 5B shows a view of the bag in a partially zipped configuration, according to one embodiment of the present disclosure.

FIG. 5B shows a view of the bag in a partially zipped configuration, according to one embodiment of the present disclosure. As depicted, bag 500*b* is in a partially zipped configuration. As depicted, first side of fastener element (not visible) is engaged with second side of fastener element (not visible) such that restrictive element 521 spans zipper 511, thereby restricting zipper slider 513 from moving in a direction that unzips zipper 511. In the depicted embodiment, zipper slider 515 is located at the attachment point between a third side edge of back panel 501 and a third side of third flap 507. In the depicted embodiment of bag 500*b* in the partially zipped configuration, unzipped second flap 505 allows access to the selectively openable aperture 531 in bag 500*b*.

Figure 6:
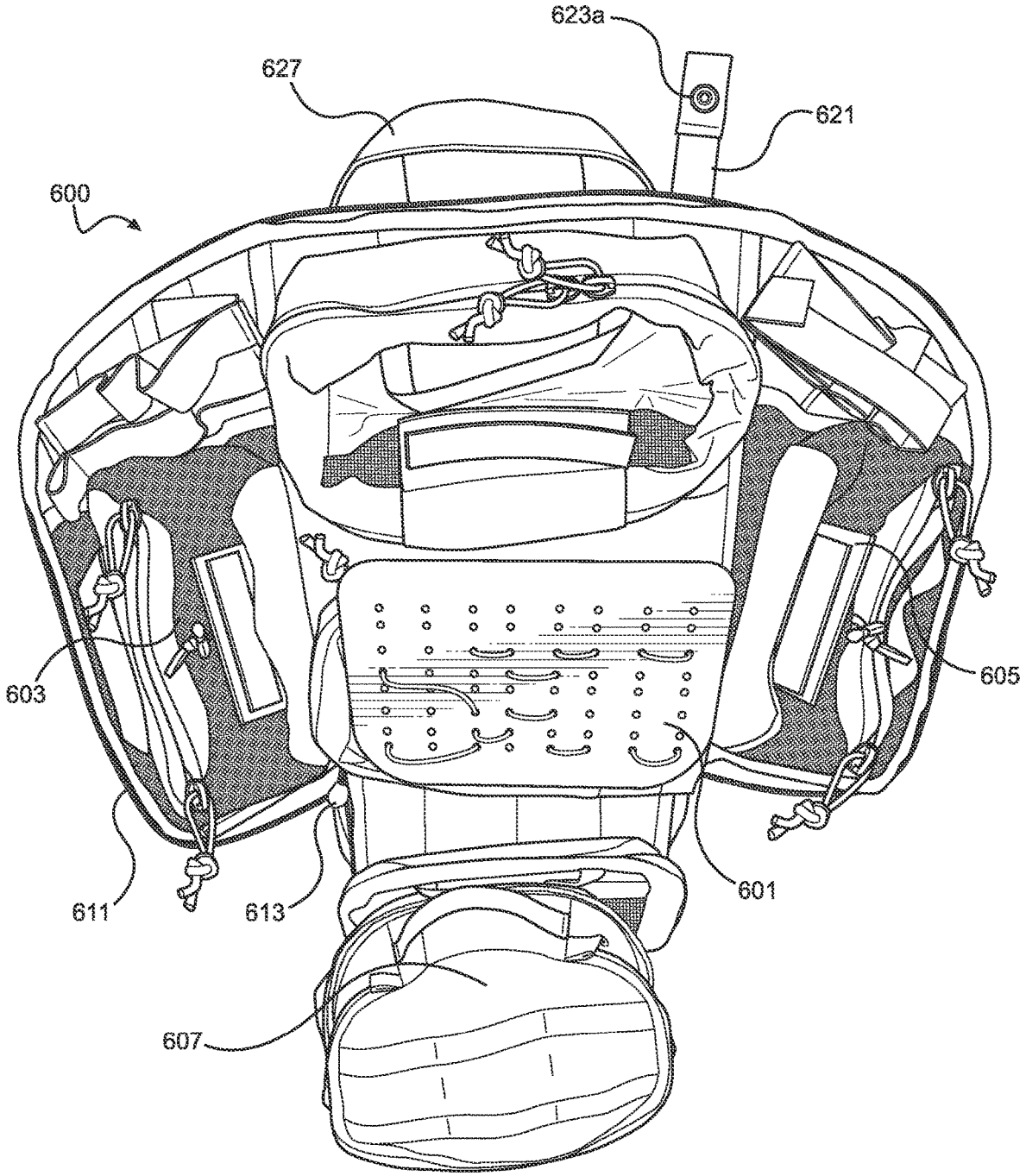
FIG. 6 shows a diagram of the inside surface of a bag in an unzipped configuration, according to another embodiment of the present disclosure.

FIG. 6 shows a diagram of the inside surface of a bag in an unzipped configuration, according to another embodiment of the present disclosure. In the depicted embodiment, bag 600 has back panel 601, first flap 603, second flap 605, and third flap 607. As depicted, first flap 603 extends from a first side edge of back panel 601, second flap 605 extends from a second side edge of back panel 601 opposite the first side edge of back panel 601, and third flap 607 extends from a third side edge of back panel 601. In the depicted embodiment, the inside surface of bag 600 has numerous pouches, pockets, straps, loops, and other accessories in which to store and/or secure a variety of equipment and supplies.

In the depicted embodiment, zipper 611 is attached to and extends around an outer edge of back panel 601, first flap 603, second flap 605, and third flap 607. When bag 600 is in a zipped configuration, first flap 603, second flap 605, and third flap 607 each fold over, such that first flap 603 forms a first side panel, second flap 605 forms a second side panel, and third flap 607 forms a front panel. In some embodiments, third flap 507 forms a bottom panel, a front panel, and a top panel of bag 600 as third flap 607 folds over when bag 600 is in a zipped configuration.

The depicted embodiment of bag 600 also includes restrictive element 621 and first side of fastener element 623*a* disposed on restrictive element 621. In the depicted embodiment, restrictive element 621 is a strap. In some embodiments, restrictive element may be a handle. In the depicted embodiment, bag 600 further includes a separate handle 627. In the depicted embodiment, a first restrictive element 621 is disposed next to one side of handle 627. In some embodiments, a second restrictive element (not shown) is disposed next to the other side of handle 627, opposite first restrictive element 621. In some embodiments, restrictive element 621 is made of a flexible material, including canvas, nylon, cotton, polyester, leather, rubber, or any combination thereof. As depicted, first side of fastener element 623*a* is a snap fastener which selectively attaches to second side of fastener element (not shown). In some embodiments, fastener elements may be one of a snap fastener, a button, a hook and loop fastener, a hook and eye fastener, a toggle clasp, a snap hook, and a buckle. The depicted embodiment has one restrictive element 621 having a single fastener element. In some embodiments, there are more than one restrictive element 621 having one or more fastener elements.

Figure 7:
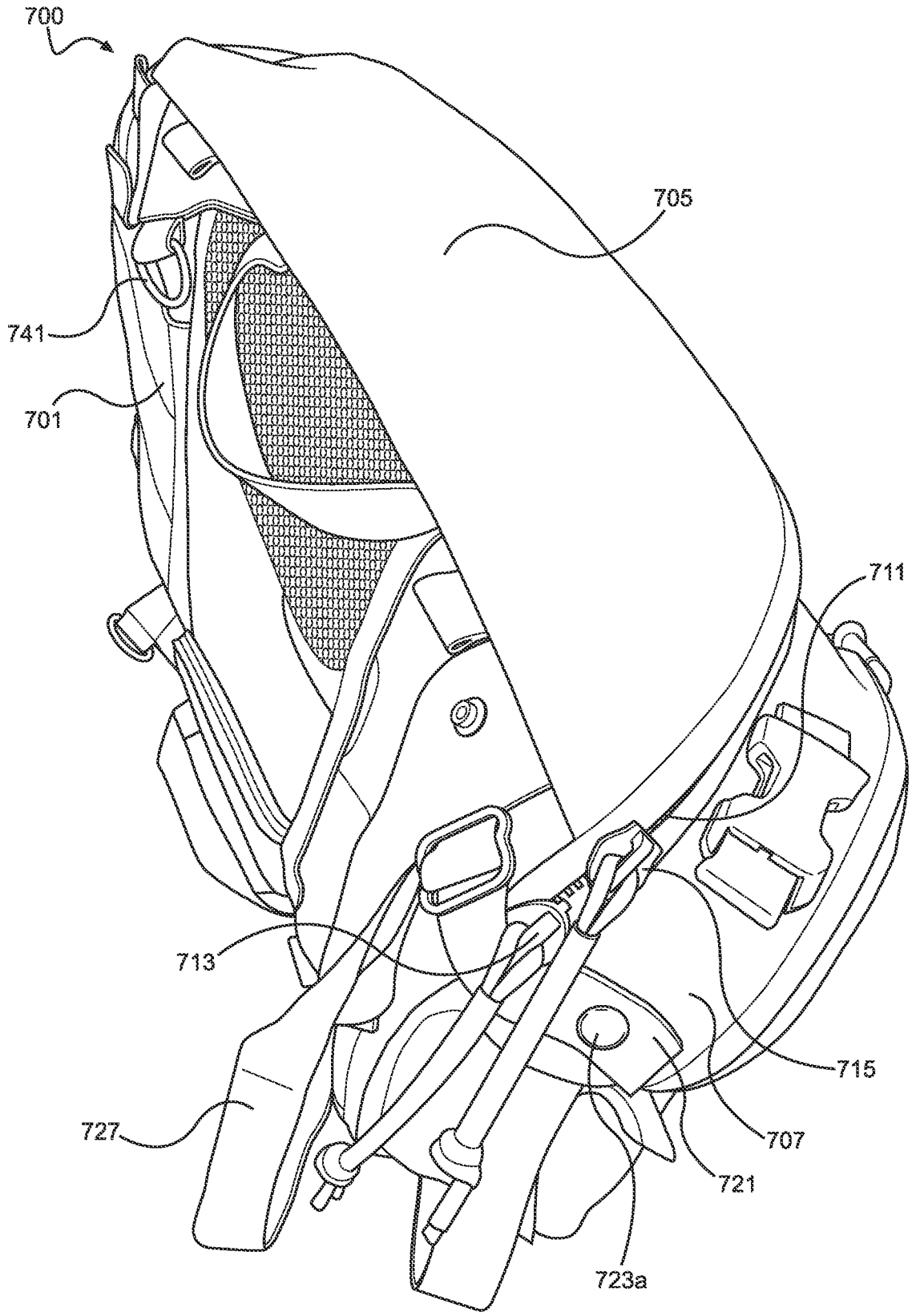
FIG. 7 shows a diagram of the bag in a zipped configuration, according to another embodiment of the present disclosure.

FIG. 7 shows a diagram of the bag in a zipped configuration, according to another embodiment of the present disclosure. The depicted view shows bag 700 in a zipped configuration with a perspective view of back panel 701 and second flap 705. In the depicted embodiment, restrictive element 721 has a first end and a second end, wherein the first end is attached to back panel 701 on a first side of zipper 711, and the second end is selectively attached to third flap 707 on a second side of zipper 711. In the depicted embodiment, the first end of restrictive element 721 is sewn to back panel 701 of bag 700. In some embodiments, the first end of restrictive element 721 is attached to bag 700 via a selective attachment. In some embodiments, the selective attachment for the first end of restrictive element 721 is one of a snap fastener, a button, a hook and loop fastener, a hook and eye fastener, a toggle clasp, a snap hook, and a buckle.

In the depicted embodiment, first side of fastener element 723*a* is disposed on the second end of restrictive element 721, and second side of fastener element (not visible) is disposed on third flap 707 on a second side of zipper. As such, when first side of fastener element 723*a* engages with second side of fastener element (not visible), restrictive element 721 spans zipper 711. In some embodiments, when the first side of fastener element 723*a* and second side of fastener element (not visible) are engaged, restrictive element 721 is substantially flush against zipper 711 restricting movement of zipper sliders 713, 715 abutting against restrictive element 721.

In the depicted embodiment, back panel 701 of bag 700 further comprises securing mechanism 741. In some embodiments, bag 700 may include a plurality of securing mechanisms to attach one or more removable straps to form one of a shoulder bag and a backpack. In the depicted embodiment, securing mechanism 741 is a D-ring. In some embodiments, securing mechanism 741 may be one of an O-ring, a loop, a hook, and the like. In some embodiments, various removable items such as straps, keychains, tags, gear, and the like may be removably attached to said securing mechanism 741 using an attachment mechanism, including a snap hook, straps with hook and loop closure, straps with a snap closure, straps with a buckle, and other ways of attachment to securing mechanism 741.

Figure 8:
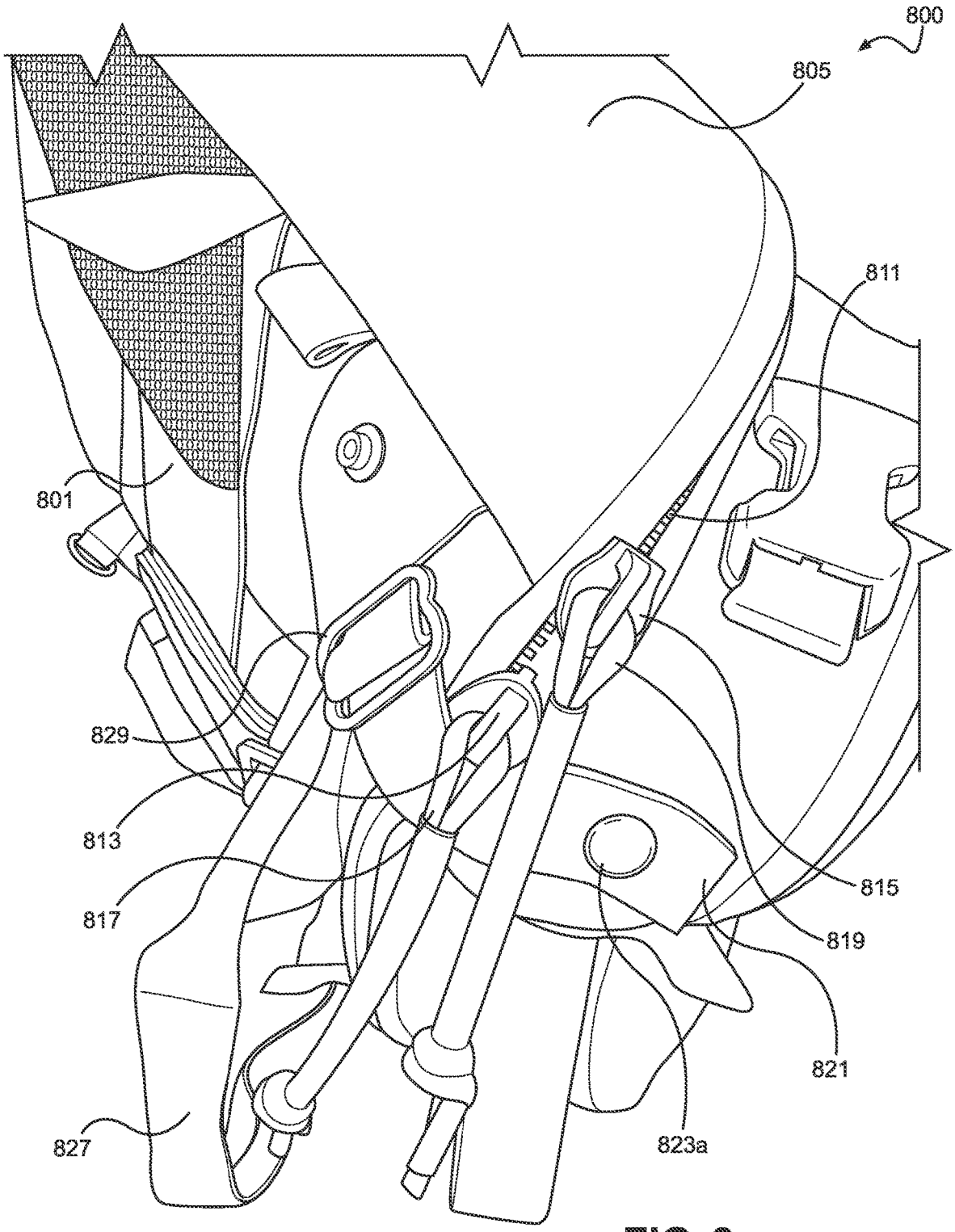
FIG. 8 shows a close-up view of an exemplary restrictive element of the bag, according to another embodiment of the present disclosure.

FIG. 8 shows a close-up view of an exemplary restrictive element of the bag, according to another embodiment of the present disclosure. In the depicted embodiment, restrictive element 821 further comprises a strap adjuster 829 to lengthen and shorten restrictive element 821. In some embodiments, moving strap adjuster 829 in one direction shortens restrictive element 821 such that when first side of fastener element 823*a* is engaged with second side of fastener element (not visible), restrictive element 821 spans zipper 811 positioned substantially flush against zipper 811, thereby restricting movement of zipper sliders 813, 815 in the direction past restrictive element 821. In some embodiments, moving strap adjuster 829 in a second direction lengthens restrictive element 821 such that restrictive element 821 is still positioned substantially flush against zipper 811 while accommodating the increased thickness of a fully packed bag 700.

In the depicted embodiment, zipper slider 813 abuts against restrictive element 821 that is substantially flush against zipper 811. Additionally, as depicted, zipper pull 817 lays over the surface of restrictive element 821. In some embodiments zipper pulls 817, 819 further ensure that zipper slider 813, 815 does not slip under and/or past restrictive element 821. In the depicted embodiment, zipper sliders 813, 815 have zipper pulls 817, 819 that are of sufficient length and material, providing leverage as an additional means to restrict movement of zipper sliders 813, 815. In some embodiments, zipper pulls 817, 819 may have a length greater than the width of restrictive element 821. In some embodiments, zipper pulls 817, 819 may have a length less than or equal to the width of restrictive element 821.

Figure 9:
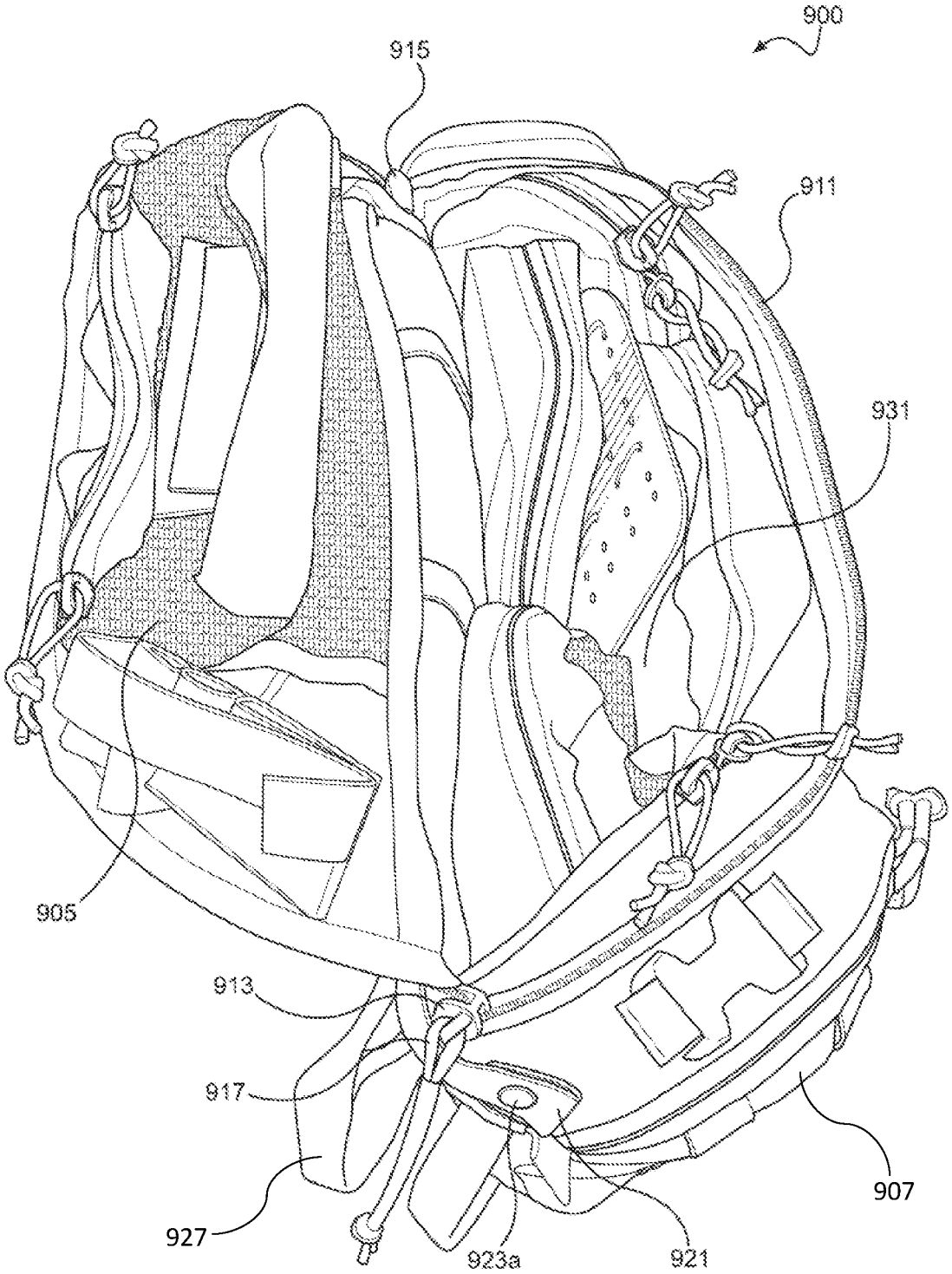
FIG. 9 shows a diagram of the bag in a partially zipped configuration, according to another embodiment of the present disclosure.

FIG. 9 shows a diagram of the bag in a partially zipped configuration, according to another embodiment of the present disclosure. In the depicted embodiment, bag 900 is in a partially zipped configuration with second flap 905 not yet folded over, allowing access to the selectively openable aperture 931 in bag 900. As depicted, first side of fastener element 923*a* disposed on restrictive element 921 is engaged with second side of fastener element (not visible). Restrictive element 921 is substantially flush against zipper 911 restricting movement of zipper slider 913 abutting against restrictive element 921, preventing zipper slider 913 from further sliding past restrictive element 921 to unzip zipper 911. The depicted embodiment of bag 900 has a second zipper slider 915 that zips zipper 911 when moved in the direction towards zipper slider 913. In the depicted embodiment, when bag 900 is in a zipped configuration, second flap 905 folds over and forms a side panel of bag 900. In some embodiments, bag 900 is selectively openable at one of a first side, a second side, and a top side.

In the depicted embodiment, the inside of the bag is accessible through the selectively openable aperture 931 as the second flap 905 or side panel of bag 900 is unzipped as zipper slider 913 abuts against restrictive element 921. In some embodiments, third flap 907 may fold over forming a top panel, a front panel, and a bottom panel of bag 900. In some embodiments, the inside of bag 900 is accessible through a selectively openable aperture from the top panel of the bag. In some embodiments, the bag may be turned on its side, and the inside of the bag is accessible through a selectively openable aperture from a side panel.

In the depicted embodiment, a first restrictive element 921 is disposed next to one side of handle 927. In some embodiments, a second restrictive element (not shown) is disposed next to the other side of handle 927, opposite first restrictive element 921. In some embodiments, a second selectively openable aperture may be formed when the first restrictive element 921 and the second restrictive element (not shown) are engaged, wherein both restrictive elements' first side of fastener elements 923*a* are engaged with second side of fastener elements (not visible), and first zipper slider 913 and second zipper slider (not shown) are positioned between the first restrictive element 921 and second restrictive element (not shown) so that the first zipper slider 913 and second zipper slider (not shown) are respectively restricted by the first restrictive element 921 and second restrictive element (not shown) that have their respective fastener elements engaged, thereby forming a second selectively openable aperture therebetween. In some embodiments, the second selectively openable aperture is a top panel of the bag.

In the depicted embodiment, restrictive element 921 of bag 900 is a strap with a first side of fastener element 923*a* disposed on restrictive element 921. In some embodiments, bag 900 may have more than one restrictive element. In some embodiments, bag 900 may have a first restrictive element and a second restrictive element, each restrictive element having a first end and a second end, wherein the first end is attached to the bag on a first side of the zipper and the second end is selectively attached to the bag on a second side of the zipper using a fastener element, wherein when the second end is engaged on the second side of the zipper, each restrictive element spans the zipper and restricts movement of one or more zipper sliders forming a first selectively openable aperture of the bag. In some embodiments, bag 900 may have a first zipper slider, a second zipper slider, a first restrictive element, and a second restrictive element, wherein when the first zipper slider and the second zipper slider are positioned between the first restrictive element and the second restrictive element, and the first restrictive element is engaged and the second restrictive element is engaged, the restriction of the zipper sliders by the first and the second restrictive elements forms a second selectively openable aperture therebetween. In some embodiments, the second selectively openable aperture may be one of a side panel of the bag or a top panel of the bag.

From the above description, it is manifest that various techniques can be used for implementing the concepts described in the present application without departing from the scope of those concepts. Moreover, while the concepts have been described with specific reference to certain implementations, a person having ordinary skill in the art would recognize that changes can be made in form and detail without departing from the scope of those concepts. As such, the described implementations are to be considered in all respects as illustrative and not restrictive. It should also be understood that the present application is not limited to the particular implementations described above, but many rearrangements, modifications, and substitutions are possible without departing from the scope of the present disclosure.

What is claimed is:

1. A bag, comprising:

a back panel;

at least one flap extending from the back panel, wherein the back panel and the at least one flap extending from the back panel lie substantially flat when in an unzipped configuration;

a zipper attached to and extending around an outer edge of the back panel and the at least one flap extending from the back panel, wherein the at least one flap comprises at least one of a first side panel, a second side panel, and a front panel of the bag when the bag is in a zipped configuration;

a first restrictive element for selectively restricting a movement of a first zipper slider along the zipper, the first restrictive element having a first end and a second end, wherein the first end is attached to the bag on a first side of the zipper and the second end is selectively attached to the bag on a second side of the zipper using a fastener element, wherein the restrictive element is positioned along the zipper path at a location between a first terminal end of the zipper and a second terminal end of the zipper, wherein when the second end is engaged on the second side of the zipper, the first restrictive element spans the zipper and is substantially flush to the zipper path, thereby restricting movement of a first zipper slider and preventing the first zipper slider from further sliding past the first restrictive element to unzip zipper when the first zipper slider abuts the first restrictive element, thereby forming a first selectively openable aperture of the bag.

2. The bag of claim 1, wherein the at least one flap includes a first flap extending from a first side edge of the back panel, a second flap extending from a second side edge of the back panel opposite the first side edge of the back panel, and a third flap extending from a third side edge of the back panel, wherein when the bag is in a zipped configuration, the first flap meets a first side edge of the third flap, the second flap meets a second side edge of the third flap opposite the first side of the third flap, and a third side edge of the third flap meets a fourth side edge of the back panel.

3. The bag of claim 1, wherein the bag further comprises a second zipper slider and a second restrictive element, wherein when the first zipper slider and the second zipper slider are positioned between the first restrictive element and the second restrictive element, and the first restrictive element is engaged and the second restrictive element is engaged, the restriction of the zipper sliders by the first and the second restrictive elements forms a second selectively openable aperture therebetween.

4. The bag of claim 3, wherein the second selectively openable aperture is one of a top panel of the bag and a side panel of the bag.

5. The bag of claim 1, wherein the first end of the restrictive element is attached to the bag via a selective attachment.

6. The bag of claim 1, wherein the bag is selectively openable at one of a first side, a second side, and a top side.

7. The bag of claim 1, wherein the back panel further comprises one or more removable support elements inserted along a length of the back panel, extending from a top of the back panel to a bottom of the back panel.

8. The bag of claim 7, wherein the removable support elements are inserted across a first flap, the back panel, and a second flap, substantially perpendicular to the length of the back panel from which the removable support elements were removed from, thereby maintaining the bag in a substantially flat configuration while the bag is in the unzipped configuration.

9. The bag of claim 7, wherein the removable support elements are made of one of metal, wood, polyethylene, and cardboard.

10. The bag of claim 1, wherein the back panel further comprises a plurality of securing mechanisms to attach at least one removable strap forming one of a shoulder bag and a backpack.

11. The bag of claim 1, wherein the restrictive element is one of a strap and a handle.

12. The bag of claim 1, wherein the restrictive element is made of a flexible material, including canvas, nylon, cotton, polyester, leather, rubber, or any combination thereof.

13. The bag of claim 1, wherein the fastener element is one of a snap fastener, a button, a hook and loop fastener, a hook and eye fastener, a toggle clasp, a snap hook, and a buckle.

14. The bag of claim 1, wherein the front panel includes a bottom, a front, and a top when in a zipped configuration.

15. The bag of claim 1, wherein a first side of the fastener element is disposed on the restrictive element and a second side of the fastener element is disposed on the second side of the zipper.

16. The bag of claim 1, wherein the first selectively openable aperture is a side panel of the bag.

17. The bag of claim 1, wherein the zipper extends substantially around an entire perimeter of the outer edge of the back panel and the at least one flap.

18. The bag of claim 1, wherein the bag further comprises a second zipper slider.

* * * * *